US006920855B2

(12) United States Patent
Takenaka et al.

(10) Patent No.: US 6,920,855 B2
(45) Date of Patent: Jul. 26, 2005

(54) VALVE TIMING ADJUSTMENT DEVICE

(75) Inventors: Akihiko Takenaka, Anjo (JP); Takayuki Inohara, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/946,106

(22) Filed: Sep. 22, 2004

(65) Prior Publication Data

US 2005/0061277 A1 Mar. 24, 2005

(30) Foreign Application Priority Data

Sep. 22, 2003 (JP) ..... 2003-330142

(51) Int. Cl.[7] ..... F01L 1/34

(52) U.S. Cl. ..... 123/90.17; 123/90.15; 74/568 R; 92/121

(58) Field of Search ..... 123/90.12, 90.15–90.17, 123/90.31; 74/568 R; 464/1, 2, 160; 92/121, 122

(56) References Cited

U.S. PATENT DOCUMENTS 5,161,493 A * 11/1992 Ma ..... 123/90.17
6,170,447 B1 * 1/2001 Kohrs et al. ..... 123/90.17
2003/0226532 A1 12/2003 Takenaka et al.
2004/0084000 A1 5/2004 Takenaka et al.
2005/0022765 A1 * 2/2005 Takenaka et al. ..... 123/90.17

FOREIGN PATENT DOCUMENTS

JP 2001-41013 2/2001

* cited by examiner

*Primary Examiner*—Thomas Denion
*Assistant Examiner*—Jaime Corrigan
(74) *Attorney, Agent, or Firm*—Nixon & Vanderhye P.C.

(57) ABSTRACT

A valve timing adjustment device for promptly switching a rotational phase includes a guide rotary body having a guide passage containing a movable body. The guide passage includes a variable radial dimension relative to a rotational centerline. The guide rotary body rotates relative to a driving rotary body and guides the movable body in the guide passage. A phase change mechanism changes the rotational phase of a driven shaft relative to a drive shaft according to the position of the movable body in the guide passage. The guide passage has a gradually decreasing region and a gradually increasing region. The gradually decreasing region slants toward an axis of the guide rotary body. The gradually increasing region slants relative toward the axis of the guide rotary body. The gradually decreasing region and the gradually increasing region are connected.

13 Claims, 14 Drawing Sheets

VALVE TIMING ADJUSTMENT DEVICE

CROSS REFERENCE TO RELATED APPLICATIONS

This application is based upon and claims the benefit of priority of Japanese Patent Application No. 2003-330142, filed on Sep. 22, 2003, the contents of which are incorporated herein by reference.

FIELD OF THE INVENTION

The present invention relates to a valve timing adjustment device for adjusting an opening/closing time (hereinafter referred to as "valve timing") of at least one of an intake valve and an exhaust valve of an internal combustion engine (hereinafter referred to as an "engine").

BACKGROUND OF THE INVENTION

Power transmission systems such as engines are typically used to transmit drive torque from a drive shaft to a driven shaft. A variety of such engines typically include a valve timing adjustment device. A conventional valve timing adjustment device adjusts the valve timing of the engine by opening or closing at least one of an intake valve and an exhaust valve to change the rotational phase of the driven shaft relative to the drive shaft (hereinafter simply referred to as the "rotational phase"). For example, JP-A No. 2001-41013 discloses a valve timing adjustment device including a phase change mechanism, a lever member, and a movable operating member. The phase change mechanism includes a sprocket rotating in synchronization with a drive shaft. The lever member rotates in synchronization with a driven shaft. The phase change mechanism moves the movable operating member according to a relative rotational movement between the lever member and the sprocket to change the rotational phase.

JP-A No. 2001-41013 further discloses a guide plate for controlling movement of the movable operating member. More specifically, the movable operating member fits into a guide wall of the guide plate. The moving operating member is guided in a length direction of a passage in the guide wall according to the relative rotation between the guide plate and the sprocket. The passage by which the movable operating member is guided is formed in a spiral shape. The passage includes a radial dimension extending from a rotational centerline of the guide plate that gradually increases toward one end. Therefore, when the movable operating member moves to one end of the spiral passage and away from the rotational centerline, the phase change mechanism sets the rotational phase to a delay side. Alternatively, when the movable operating member moves to the other end of the spiral passage and closer to the rotational centerline, the phase change mechanism sets the rotational phase to an advance side.

Recently, valve timing adjustment devices have been required to perform multiple operations in a short period of time. Specifically, current valve timing adjustment devices must adjust the rotational phase between the delay side immediately after startup of the engine to achieve the most delayed phase. Immediately thereafter, the valve timing adjustment device must change the rotational phase to the advance side to achieve the most advanced phase. However, the device disclosed in JP-A No. 2001-41013 cannot perform such immediate operations. A change in the direction of the rotational phase is limited by the position of the movable operating member in the passage. For example, if the movable operating member is positioned in the delay side of the passage, only a delay in the rotational phase may be promptly changed. Alternatively, if the movable operating member is positioned in the advance side of the passage, only the advance in the rotational phase me be promptly changed. To change the rotational phase from a delay to an advance or vice versa, the relative rotational direction between the guide plate and the sprocket must change. Such a change requires time that prevents the valve timing adjustment device disclosed in JP-A No. 2001-41013 from promptly changing the direction of the change in rotational phase.

Therefore, an object of the present invention is to provide a valve timing adjustment device capable of promptly switching the direction of change of the rotational phase.

SUMMARY OF THE INVENTION

A valve timing adjustment device according to the present invention includes a guide rotary body and a movable body. The guide rotary body includes a guide passage containing the movable body. The guide passage includes a gradually decreasing region and a gradually increasing region. The gradually decreasing region includes a gradually decreasing radial dimension relative to a centerline thereof. The gradually increasing region includes a gradually increasing radial dimension relative to a centerline thereof. The gradually decreasing and increasing regions are coaxially aligned with and connected to each other. Therefore, the gradually decreasing region slants in the radial direction relative to an axis of the guide rotary body such that its radial dimension gradually decreases toward the rotational centerline between the center and one end of the guide passage. Furthermore, the gradually increasing region slants relative to the axis of the guide rotary body such that its radial dimension gradually increases between the center and another end of the guide passage. Thus, rotation of the guide rotary body relative to a driving rotary body that is synchronized with a drive shaft causes the movable body to travel in a direction within the guide passage according to a direction of the relative rotation.

When the movable body moves from one end of the guide passage to the other, it first moves away from the centerline and then toward the centerline. A phase change means changes a rotational phase to one of a delay side and an advance side when the movable body moves away from the rotational centerline. The phase change means changes the rotational phase to the other of the delay side and the advance side when the movable body moves closer to the rotational centerline. Therefore, changing the direction of movement of the movable body relative to the rotational centerline changes the direction of change of the rotational phase. In this manner, according to the invention claimed in claims 1 to 13, the direction of change of the rotational phase can only be switched by moving the movable body from one end of the passage to the other. This is achieved through rotation of the guide rotary body relative to the driving rotary body and occurs even if the rotational direction of the guide rotary body never changes. Therefore, the direction of change of the rotational phase can be switched in a short time.

It is generally understood that an engine cannot start when the rotational phase is set to the most delayed phase or the most advanced phase. A typical engine can only start when the rotational phase is set to an intermediate phase that is located somewhere between the most delayed phase and the most advanced phase. Therefore, it is important to precisely achieve the desired intermediate phase during the starting time of the engine. However, the movable operating member disclosed in JP-A No. 2001-41013 must be positioned at the middle portion of the spiral passage to achieve an intermediate phase. When located in the middle portion of the passage, the movable operating member tends to shift and, therefore, it is difficult to achieve the desired intermediate phase with precision.

To the contrary, the present invention, as claimed in claims 2 and 3, provides a stopper in the guide rotary body. The stopper retains the movable body when the movable body is located adjacent to an end of the passage that is opposite to the gradually increasing region side of the gradually decreasing region. Furthermore, according to the invention claimed in claims 4 and 5, when the movable body moves to an end that is opposite the gradually decreasing region side of the gradually increasing region, the stopper of the guide rotary body retains the movable body and the phase change means sets the rotational phase to the intermediate phase. According to the invention claimed in claims 2 to 5, when the phase change means is set to the intermediate phase, the stopper limits further movement of the movable body. This limiting action of the stopper provides a precise realization of the desired intermediate phase.

According to the invention claimed in claim 6, a torque application means applies a pressing torque to the movable body against the stopper. This positions the movable body, with reliability, at the respective end of the passage. Therefore, the torque application means improves the reliability and accuracy of defining the intermediate phase.

According to the invention claimed in claim 7, the torque application means includes an electric motor generating the pressing torque. Therefore, the magnitude of the pressing torque can be controlled with precision.

According to the invention claimed in claim 8, the torque application means includes an elastic member generating the pressing torque by deformation. This provides a simple torque application means.

According to the invention claimed in claim 9, the gradually decreasing region may include a plurality of gradually decreasing regions. The plurality of decreasing regions sandwich the gradually increasing region. Furthermore, according to the invention claimed in claim 10, the gradually increasing region may include a plurality of gradually increasing regions. The plurality of increasing regions sandwich the gradually decreasing region. According to the invention claimed in claims 9 and 10, the direction of change of the rotational phase can be switched a plurality of times by moving the rotary body from one end of the passage to the other end without switching the relative rotational direction of the guide rotary body.

According to the invention claimed in claim 11, the gradually decreasing region and the gradually increasing region are formed as having generally straight-line shapes. However, an end of the gradually decreasing region near the gradually increasing region and an end of the gradually increasing region near the gradually decreasing region are formed in a curve shape. This increases the degree of freedom in setting the change rate as a function of a distance in the radial direction in the gradually decreasing region and the gradually increasing region. Furthermore, the guide passage can be formed with ease.

According to the invention claimed in claim 12, the gradually decreasing region and the gradually increasing region are formed as having a generally curved shape. This increases the degree of freedom in setting the change rate as a function of a distance in the radial direction in the gradually decreasing region and the gradually increasing region.

According to the invention claimed in claim 13, the gradually decreasing region and the gradually increasing region extend along a common imaginary straight line such that the guide passage can be formed with ease.

DETAILED DESCRIPTION OF THE PREFERRED EMBODIMENTS

A plurality of preferred embodiments of the present invention will now be described with reference to the drawings.

First Embodiment

Figure 2:
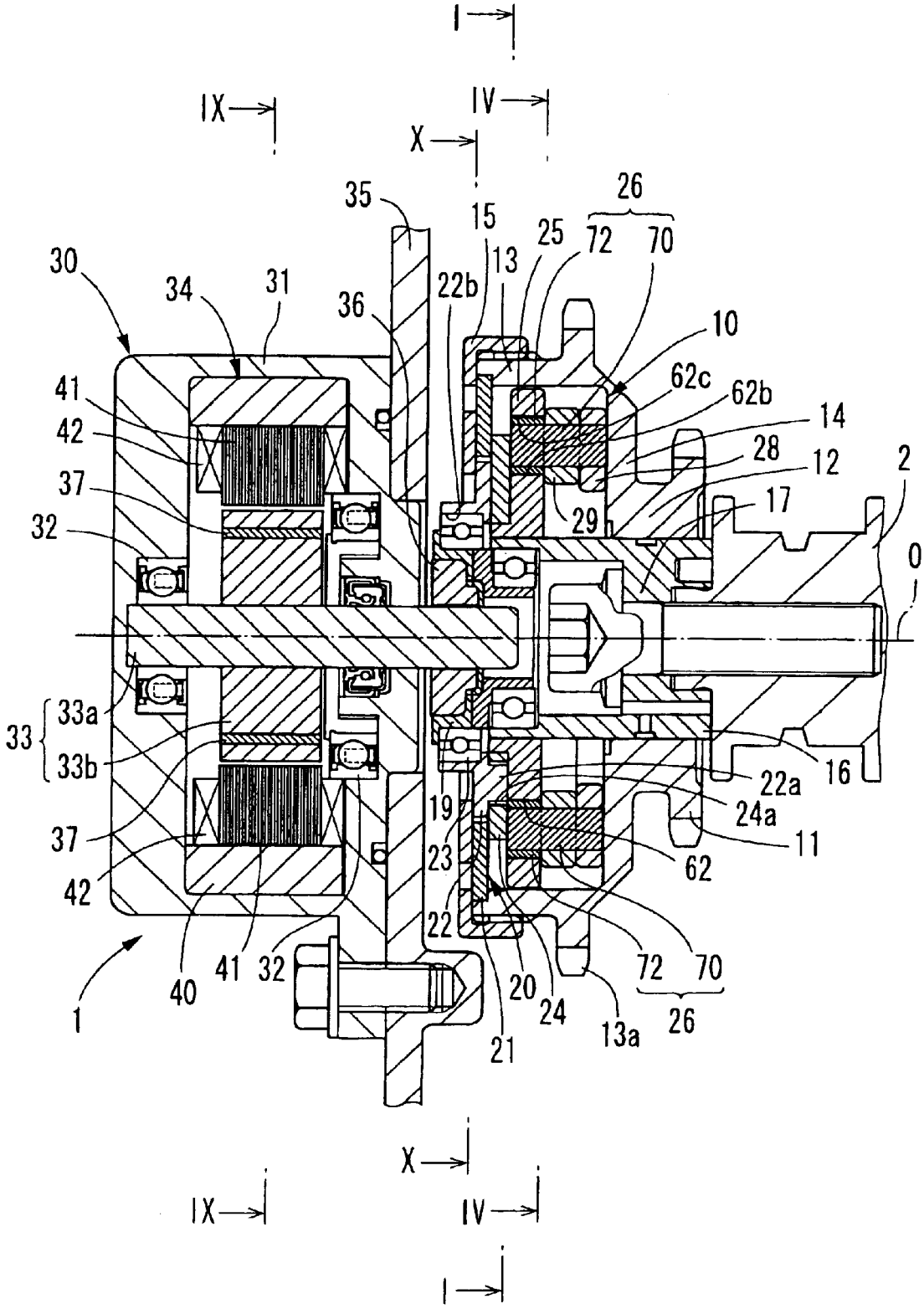
FIG. 2 is a cross-sectional view of the first embodiment of the present invention taken through line II—II of FIG. 4.

FIG. 2 depicts a valve timing adjustment device 1 according to the first embodiment of the present invention. The valve timing adjustment device 1 generally includes a transmission system for transmitting a drive torque from a drive shaft such as a crankshaft to a driven shaft such as a camshaft 2 of an engine. The valve timing adjustment device 1 adjusts the valve timing of an intake valve of the engine by changing the rotational phase of the camshaft 2 relative to the crankshaft. A hollow arrow identifies this change in FIG. 3.

The valve timing adjustment device 1 includes a phase change mechanism 10, a guide rotary body 25, a movable body 26, an electric motor 30, and a speed reducer 20.

Figure 4:
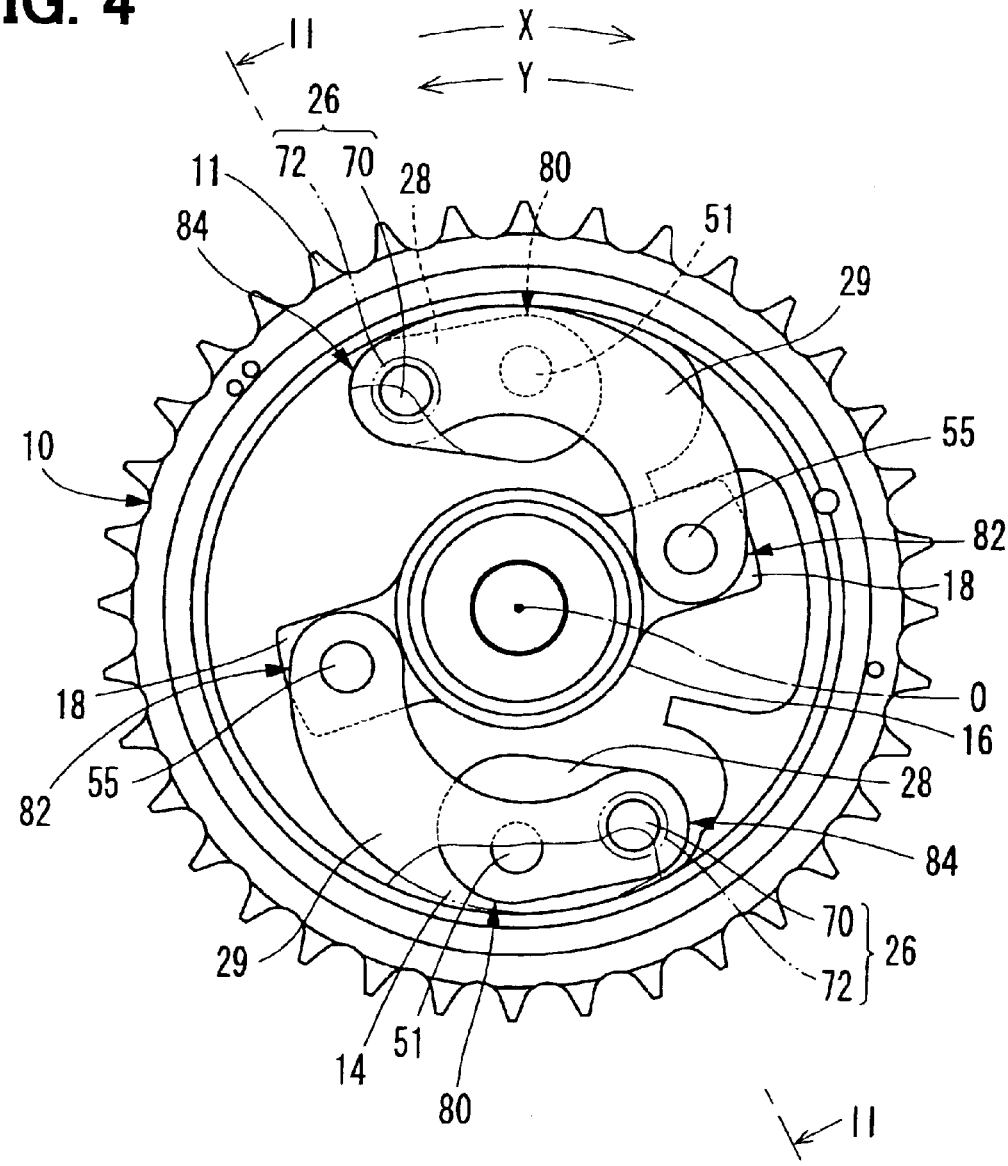
FIG. 4 is a cross-sectional view of the first embodiment of the present invention taken through line IV—IV of FIG. 2.

FIG. 2 and FIG. 4 depict the phase change mechanism 10 including a sprocket 11, an output shaft 16, and arm members 28, 29. As stated above, the phase change mechanism 10 changes the rotational phase of the camshaft 2 relative to the crankshaft. It should be noted that for the sake of clarity, hatching typically used to identify a cross-section has been omitted from FIG. 4. Similarly, hatching has been omitted from FIGS. 1, 6, and 7, which will be described in more detail below.

The sprocket 11 has a support cylinder 12, an input cylinder 13, and a link part 14, as shown in FIG. 2. The input cylinder 13 includes a larger diameter than the support cylinder 12. The link part 14 couples the support cylinder 12 to the input cylinder 13. The support cylinder 12 is rotationally supported about a centerline O on an outer peripheral wall of the output shaft 16. A chain belt (not shown) is looped over a plurality of teeth 13*a* formed on the input cylinder 13 and a plurality of teeth formed on the crankshaft. When the drive torque of the crankshaft is applied to the input cylinder 13 through the chain belt, the sprocket 11 rotates clockwise about centerline O relative to the view provided in FIG. 1 while maintaining its rotational phase relative to the crankshaft. Thus, the sprocket 11 functions as a drive rotary body rotating in synchronization with the crankshaft. The link part 14 is generally a flat plate having opposite surfaces that are substantially vertical to a line running parallel to the centerline O.

The output shaft 16 has a fixed part 17 (shown in FIG. 2) and a link part 18 (shown in FIG. 4). One end of the camshaft 2 is concentrically fixed with bolts to one end of the fixed part 17. The output shaft 16 rotates around the rotational centerline O while maintaining a rotational phase with the camshaft 2. Therefore, the output shaft 16 functions as a driven rotary body rotating in synchronization with the camshaft 2 of the driven shaft. This provides that the rotational phase of the output shaft 16 relative to the sprocket 11 is substantially the same as the rotational phase of the camshaft 2 relative to the crankshaft. The link part 18 is formed in the shape of a rectangular flat plate. Two link parts 18 are arranged such that both surfaces of the plates are vertical to a line parallel to the centerline O. The link parts 18 protrude in opposite directions from the rotational centerline O of the fixed part 17.

The arm members 28 and 29, the link parts 18, the guide rotary body 25, the movable body 26, a planetary gear 22, and a transmission rotary body 24 of a speed reducer 20 are all sandwiched by a cover 15. The cover 15 is fixed to the input cylinder 13 and the link part 14. The arm members 28 are formed as flat oval plates. Two arm members 28 are arranged such that both surfaces of the flat plates are vertical to a line that is parallel to the centerline O. A shaft member 51 couples an end of each arm member 28 to one of two positions on the link part 14 opposite the rotational centerline O from the other arm member 28 to form a rotational contraposition 80. The arm members 29 include C-shaped plates. Two arm members 29 are arranged in such a way that both surfaces of the plates are vertical to a line that is parallel to the centerline O. A shaft member 55 couples one end of each arm member 29 to the corresponding link part 18 to form a rotational contraposition 82 to the corresponding link part 18. Furthermore, the movable body 26 couples the other end of each arm member 29 to the corresponding arm member 28 via the movable body 26 to form a rotational contraposition 84 to the corresponding arm member 28.

Accordingly, the crankshaft rotates the output shaft 16 in a clockwise direction relative to the view illustrated in FIG. 4. The movable body 26 moves according to the relative rotational movement between the output shaft 16 and the sprocket shaft 11. The movement of the movable body changes the rotational phase of the camshaft 2 relative to the crankshaft, which is hereinafter referred to as the "shaft phase."

More specifically, when the radial position of the movable body 26 relative to the rotational centerline O of the guide rotary body 25 is maintained, the rotational contraposition 84 formed by the arm members 28, 29, the rotational contraposition 82 formed by the link part 18 and the arm member 29, and the rotational contraposition 80 formed by the link part 14 and the arm member 28 are maintained. Hence, the rotational phase between the output shaft and the sprocket 11, as well as the shaft phase, are maintained constant while the output shaft 16 rotates in synchronization with the camshaft 2.

When the movable body 26 moves away from the rotational centerline O, the arm member 28 rotates around the respective centerlines of the shaft member 51 and the movable body 26 relative to the link part 14 and the arm member 29. The arm member 28 thereby separates the position of the rotational contraposition 84 from the rotational centerline O. Concurrently, the arm member 29 rotates around the rotational centerline of the shaft member 55 relative to the link part 18. This causes the arm member 29 to move the rotational contraposition 82 in a delay direction Y toward the rotational contraposition 80. Therefore, when the shaft phase is changed to the delay side, the output shaft 16 rotates in the delay direction Y relative to the sprocket 11.

When the movable body 26 moves closer to the rotational centerline O, the arm member 28 rotates around respective centerlines of the shaft member 51 and the movable body 26 relative to the link part 14 and the arm member 29. This brings the position of the rotational contraposition 84 closer to the rotational centerline O. Concurrently, the arm member 29 rotates around a centerline of the shaft member 55 relative to the link part 18 to separate the position of the rotational contraposition 82 from the position of the rotational contraposition 80 in the advance direction X. Therefore, when the shaft phase is changed to the advance side, the output shaft 16 rotates in the advance direction X relative to the sprocket 11.

Figure 1:
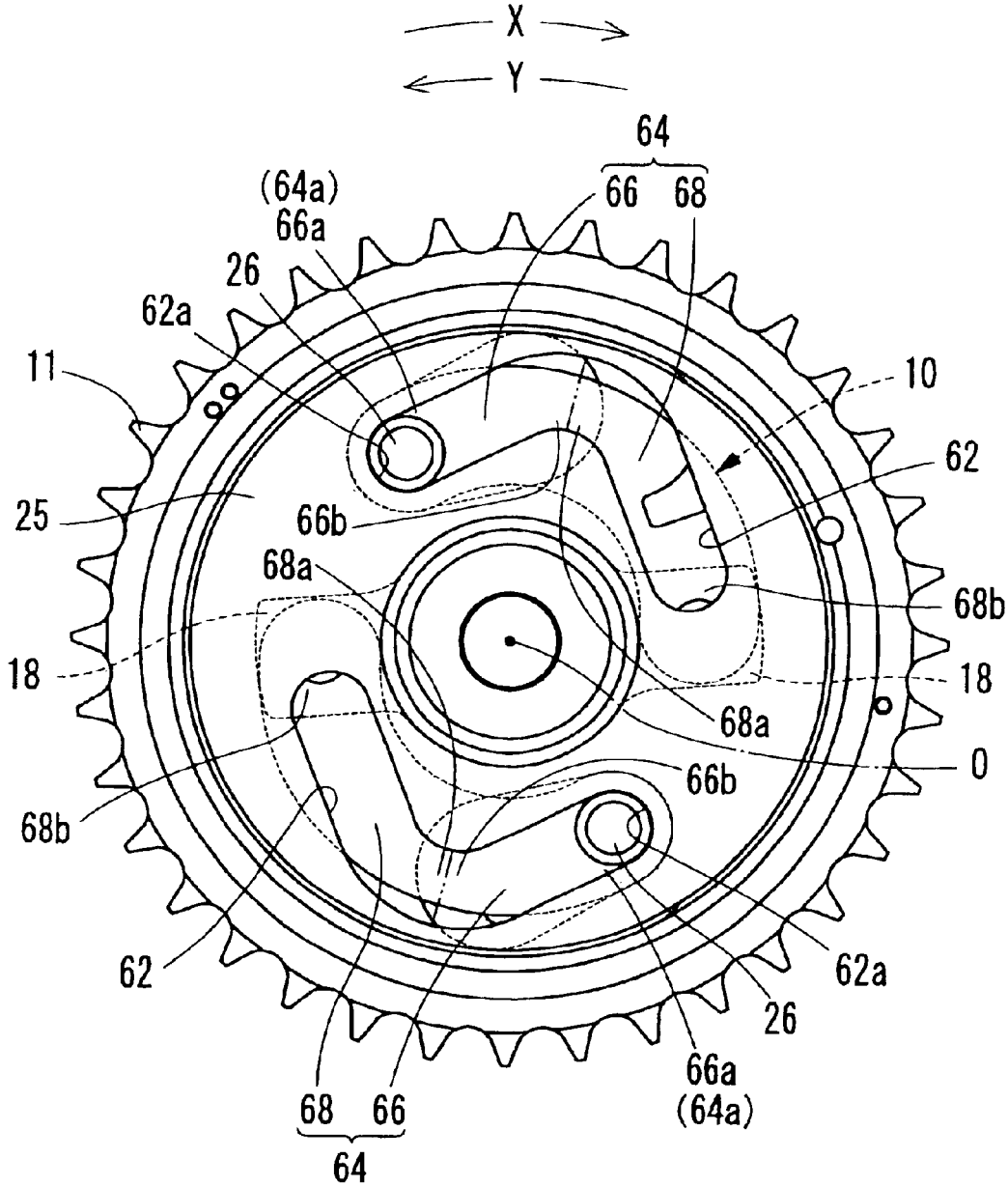
FIG. 1 is a cross-sectional view of a first embodiment of the present invention taken through line I—I of FIG. 2.
Figure 5:
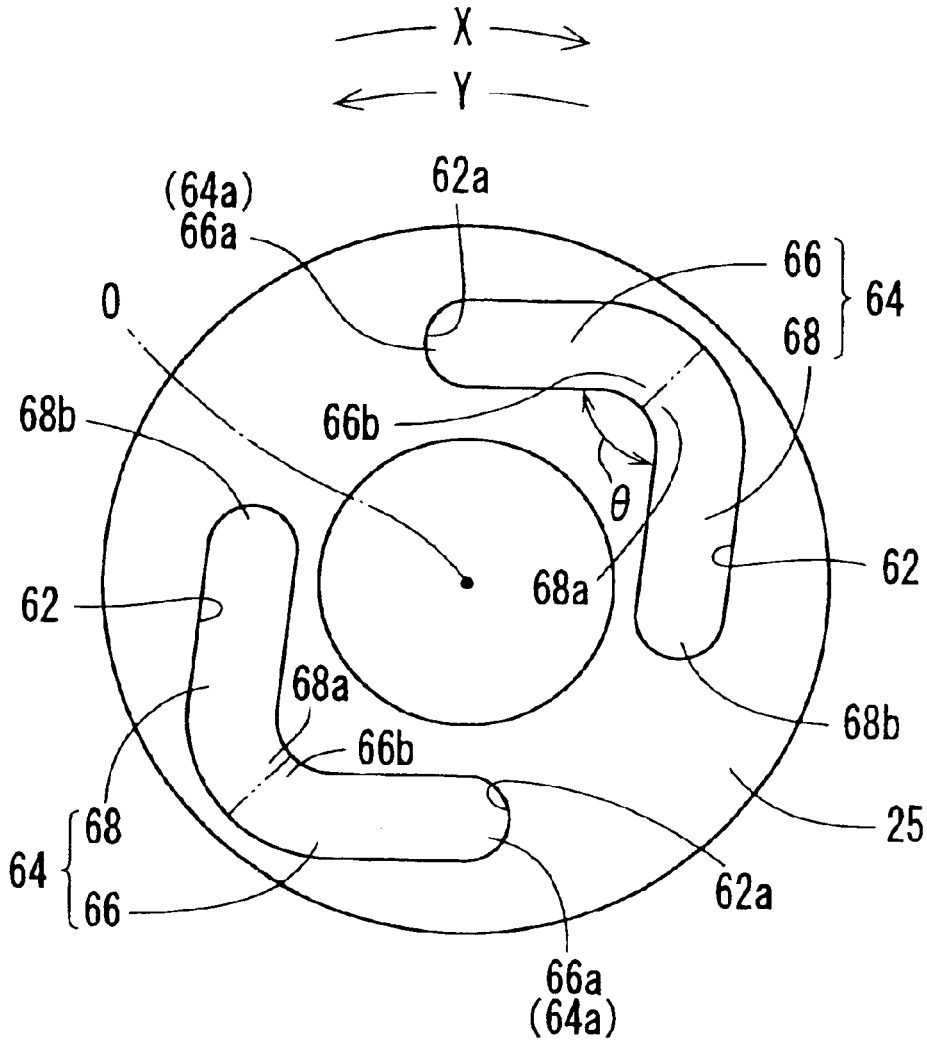
FIG. 5 is a front view of a guide rotary body of the first embodiment of the present invention.

Next, the guide rotary body 25 and the movable body 26 will be described. As shown in FIG. 1 and FIG. 2, the guide rotary body 25 includes a circular plate arranged such that both surfaces of the plate are vertical to a line that is parallel to the rotational centerline O. A transmission rotary body 24 is fixedly fitted against one surface of the plate of the guide rotary body 25. Therefore, the guide rotary body 25 and the transmission rotary body 24 can integrally rotate around the rotational centerline O relative to the sprocket 11. The other surface of the guide rotary body 25 contacts the respective arm members 29 in a sliding manner and maintains the surfaces of the respective arm members 28, the respective link parts 18, and the link part 14 opposite to each other. FIG. 1 and FIG. 5 depict peanut slots 62 formed at two portions of the guide rotary body 25 on opposite sides of the rotational centerline O. The respective peanut slots 62 are open at both surfaces of the guide rotary body 25 and arranged in a rotational symmetry of 180° to each other. Each peanut slot 62 includes a guide passage 64 having an inner peripheral wall and a stopper 62*a*. The inner peripheral wall includes a radial dimension R that changes relative to the rotational centerline O. The stopper 62*a* comprises an end wall portion of one end 64*a* of the passage 64.

More specifically, the guide passages 64 include a gradually decreasing region 66 and a gradually increasing region 68, which are continuations of each other. The gradually decreasing region 66 slants in the radial direction relative to an axis of the guide rotary body 25 and includes a radial dimension R that decreases toward the end 64*a* of the guide passage 64. The gradually decreasing region 66 also includes an end 66*a* that is adjacent to the end 64*a* of the guide passage 64 blocked by the stopper 62*a*. As shown in FIG. 5, the gradually decreasing region 66 extends from the end 66*a* to the end 66*b* in the advance direction X. Furthermore, the gradually decreasing region 66 slants from the end 66*a* away from the rotational centerline O toward the end 66*b*.

The gradually increasing region 68 slants in the radial direction relative to the axis of the guide rotary body 25 and includes a radial dimension R that increases toward the one end 64*a* of the guide passage 64. The gradually increasing region 68 also includes an end 68*a* that is adjacent to the end 66*b* of the gradually decreasing region 66. A double dot and dashed line shows this connection boundary between the end 66*b* of the gradually decreasing region 66 and the end 68*a* of the gradually increasing region 68. As shown in FIG. 5, the gradually increasing region 68 extends from the end 68*b* to the end 68*a* in the delay direction Y. Furthermore, the gradually increasing region 68 slants from the end 68*b* away from the rotational centerline O to the end 68*a*.

In this first embodiment, the gradually decreasing region 66 and the gradually increasing region 68 except for portions near the ends 66*b*, 68*a* are formed in generally straight lines. The end 66*b* of the gradually decreasing region 66 and the end 68*a* of the gradually increasing region 68 join at a curve. Furthermore, the gradually decreasing region 66 and the gradually increasing region 68 extend at an angle θ relative to each other except at the connection between the ends 66*b* and 68*a*. In an exemplary embodiment, the angle θ is set to 90 degrees. Still further, the gradually decreasing region 66 is slightly shorter than the gradually increasing region 68.

As shown in FIG. 1 and FIG. 2, the movable body 26 includes two movable bodies 26 corresponding to the peanut slots 62 and the guide passages 64 on their inner peripheral sides. Each movable body 26 includes a core member 70 and a shell member 72. The core members 70 are formed in a cylindrical shape and are sandwiched between the transmission rotary body 24 and the link part 14. The shell members 72 are formed in a cylindrical shape and are concentrically disposed on an outer peripheral wall of one end of the core member 70. The shell members 72 are sandwiched between the transmission rotary body 24 and the arm member 29. Therefore, the shell members 72 include centerlines that are parallel to the rotary centerline O. Accordingly, side wall portions 62*b*, 62*c* of the peanut slots 62 corresponding to the outer peripheral wall of the shell members 72 are fitted on the outer peripheral wall of the shell members 72 from both sides in a width direction of the guide passage 64. The shell members 72 can rotate relative to the peanut slots 62 and slide in the length direction relative to the guide passage 64. Outer peripheral wall portions of the core members 70, which exclude the portions fitted into the shell members 72, are rotatably fitted in end portions of the corresponding arm members 28, 29.

When the guide rotary body 25 does not rotate relative to the sprocket 11, the movable body 26 does not slide relative to the guide rotary body 25. Rather, the movable body 26 rotates integrally with the guide rotary body 25 while maintaining its position relative to the rotational centerline O.

Figure 3:
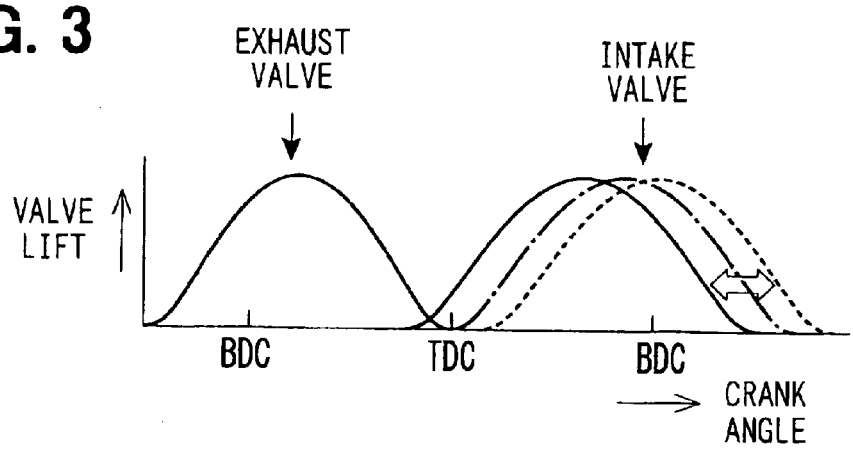
FIG. 3 is a graph illustrating a valve timing of a valve adjusted by the device of the first embodiment of the present invention.
Figure 6:
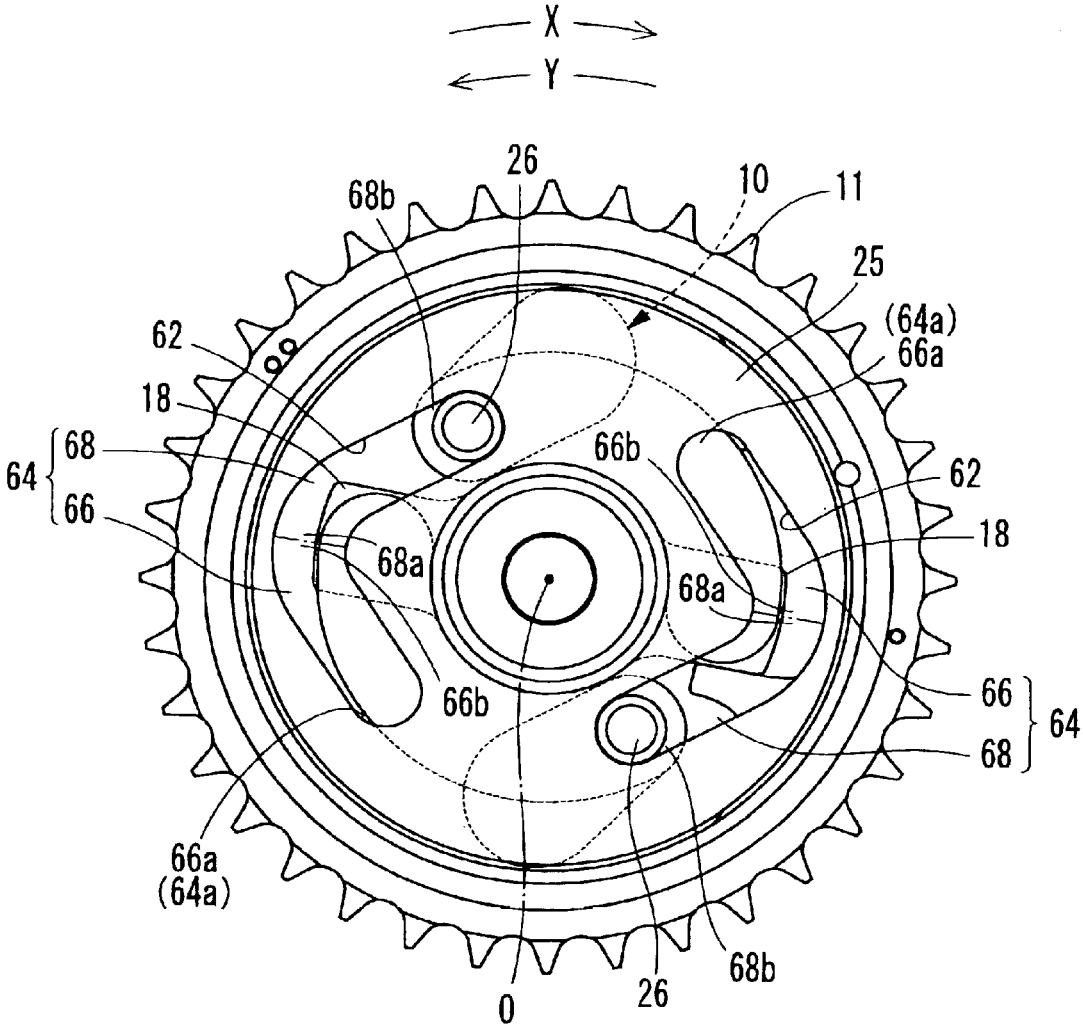
FIG. 6 is a cross-sectional view of the first embodiment of the present invention taken through line I—I of FIG. 2 and illustrating an operating state that is different from that illustrated in FIG. 1.
Figure 8:
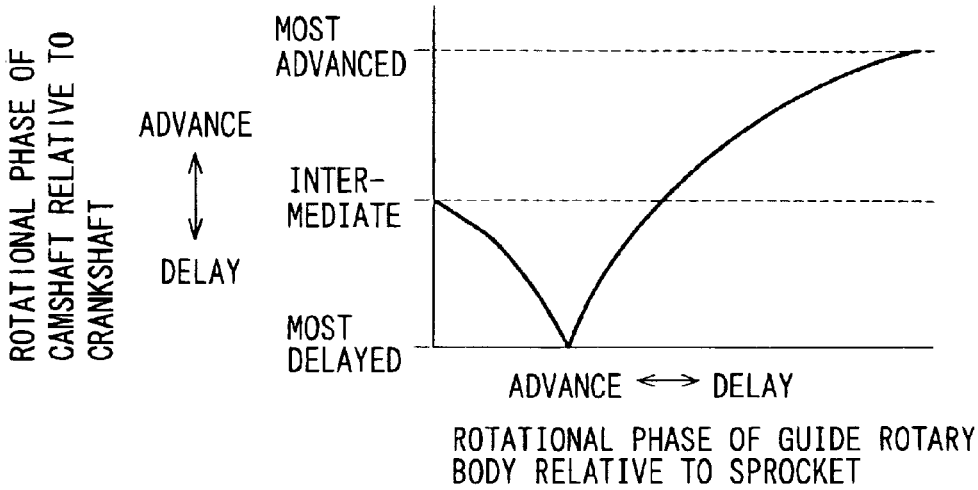
FIG. 8 is a graph illustrating operational characteristics of the first embodiment of the invention.

As shown in FIG. 6, the movable body 26 is closest to the rotational centerline O when it is located at the end 68*b* of the gradually increasing region 68. At this time, the phase change mechanism 10 defines the shaft phase as a most advanced phase, as shown in FIG. 8. The solid line in FIG. 3 represents the valve timing of the intake valve in this condition and the engine cannot be started.

With continued reference to FIG. 6, when the guide rotary body 25 rotates in the advance direction X relatively to the sprocket 11, the movable body 26 is guided in the length direction along the peanut slot 62 from the gradually increasing region 68 toward the gradually decreasing region 66. At this time, the phase change mechanism 10 changes the shaft phase from the most advanced phase to a delay phase, as shown in FIG. 8.

Figure 7:
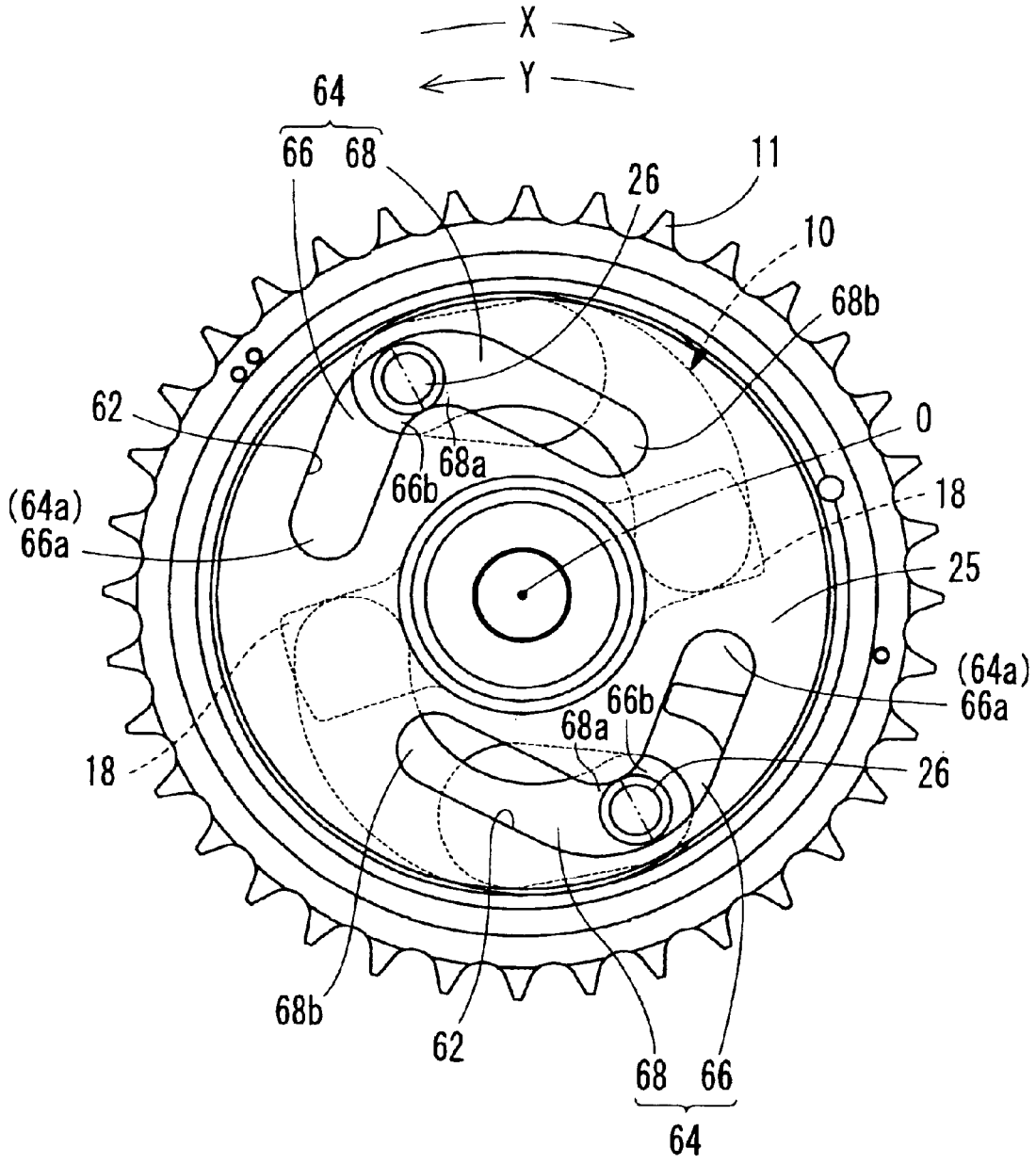
FIG. 7 is a cross-sectional view of the first embodiment of the present invention taken through line I—I of FIG. 2 and illustrating an operating state that is different from those illustrated in FIGS. 1 and 6.

With reference to FIG. 7, the movable body 26 is farthest from the rotational centerline O when the movable body 26 moves to the connection boundary between the end 68*a* of the gradually increasing region 68 and the end 66*b* of the gradually decreasing region 66. At this time, the phase change mechanism 10 defines the shaft phase to be a most delayed phase, as shown in FIG. 8. The broken line in FIG. 3 represents the valve timing of the intake valve in this condition and the engine cannot be started.

When the guide rotary body 25 rotates in the delay direction Y relative to the sprocket 11 shown in FIG. 7, the movable body 26 is guided in the length direction along the gradually increasing region 68 of the peanut slot 62 toward the end 68*b*. At this time, the phase change mechanism 10 changes the shaft phase from the most delayed phase to an advance phase, as shown in FIG. 8.

On the other hand, when the guide rotary body 25 rotates in the advance direction X relatively to the sprocket 11 shown in FIG. 7, the movable body 26 is guided in the length direction along the peanut slot 62 and moved in the gradually decreasing region 66 toward the end 66*a*. At this time, as shown in FIG. 8, the phase change mechanism 10 changes the shaft phase from the most delayed phase to an intermediate phase.

With reference to FIG. 1, when the movable body 26 moves to the end 66*a* of the gradually decreasing region 66, the movable body 26 abuts against and is retained by the stopper 62*a*. The position of the movable body 26 in FIG. 1 relative to the rotational centerline O is somewhere between the closest position, shown in FIG. 6, and the farthest position, shown in FIG. 7. In this condition, the phase change mechanism defines the shaft phase as an intermediate phase located somewhere between the most advanced phase and the most delayed phase, as shown in FIG. 8. The single dot and dashed line in FIG. 3 represents the valve timing of the intake valve at this intermediate phase and the engine can be started.

When the guide rotary body 25 rotates in the delay direction Y relative to the sprocket 11 shown in FIG. 1, the movable body 26 is guided in the length direction along the gradually increasing region 68 of the peanut slot 62 through the gradually decreasing region 66. At this time, the phase change mechanism 10 changes the shaft phase from the intermediate phase to a delay phase, as shown in FIG. 8.

Figure 9:
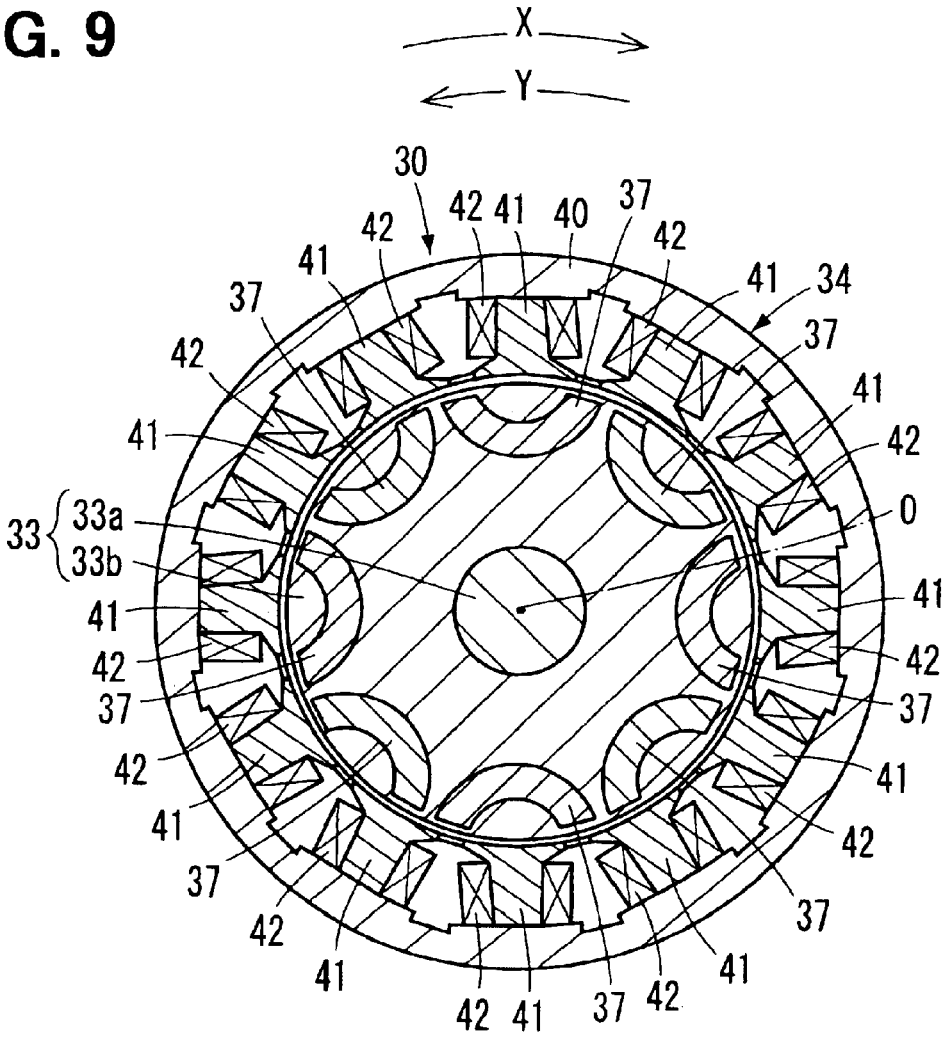
FIG. 9 is a cross-sectional view of the first embodiment of the present invention taken through line IX—IX of FIG. 2.

Next, the electric motor 30 will be described. As shown in FIG. 2 and FIG. 9, the electric motor 30 is constructed of a housing 31, bearings 32, a rotary shaft 33, and a stator 34. However, it should be appreciated that the electric motor 30 may be constructed in an alternative manner capable of serving the principles of the present invention.

The housing 31 is fixed to the engine via a stay 35. The housing 31 houses two bearings 32 and the stator 34. The rotary shaft 33 is supported by the bearings 32 at two positions in the direction of the rotational centerline O. The rotary shaft 33 rotates around the rotational centerline O. The rotary shaft 33 is fixedly coupled to an eccentric shaft 19 via a shaft coupling 36. The rotary shaft 33 rotates integrally with the eccentric shaft 19 in the clockwise direction relative to the view shown in FIG. 9. The rotary shaft 33 has a main body 33*a*and a rotor part 33*b*. The rotor part 33*b* includes a circular-shaped plate and protrudes in the radial direction to the outside of the main body 33*a*. A plurality of magnets 37 are buried in the outer peripheral wall of the rotor part 33*b*. The magnets 37 are constructed of a permanent magnet material such as a rare earth metal or the like and are positioned at equal intervals around the rotational centerline O.

The stator 34 is arranged on the outer peripheral side of the rotary shaft 33 and has a cylindrical main body 40, a core 41, and a coil 42. The core 41 is formed of a plurality of laminated iron sheets and protrudes toward the rotary shaft 33 from the inner peripheral wall of the main body 40. The core 41 includes a plurality of cores 41 positioned at equal intervals around the rotational centerline O. The coil 42 is wound around each core 41. The stator 34 forms a magnetic field on the outer peripheral side of the rotary shaft 33 in response to a control circuit (not shown) providing an electrical current through the respective coils 42. Here, the passage of the electrical current through the respective coils 42 is performed in such a way that a control torque in the delay direction Y and a control torque in the advance direction X are applied to the rotary shaft 33 by the magnetic field formed by the respective coils 42.

Figure 10:
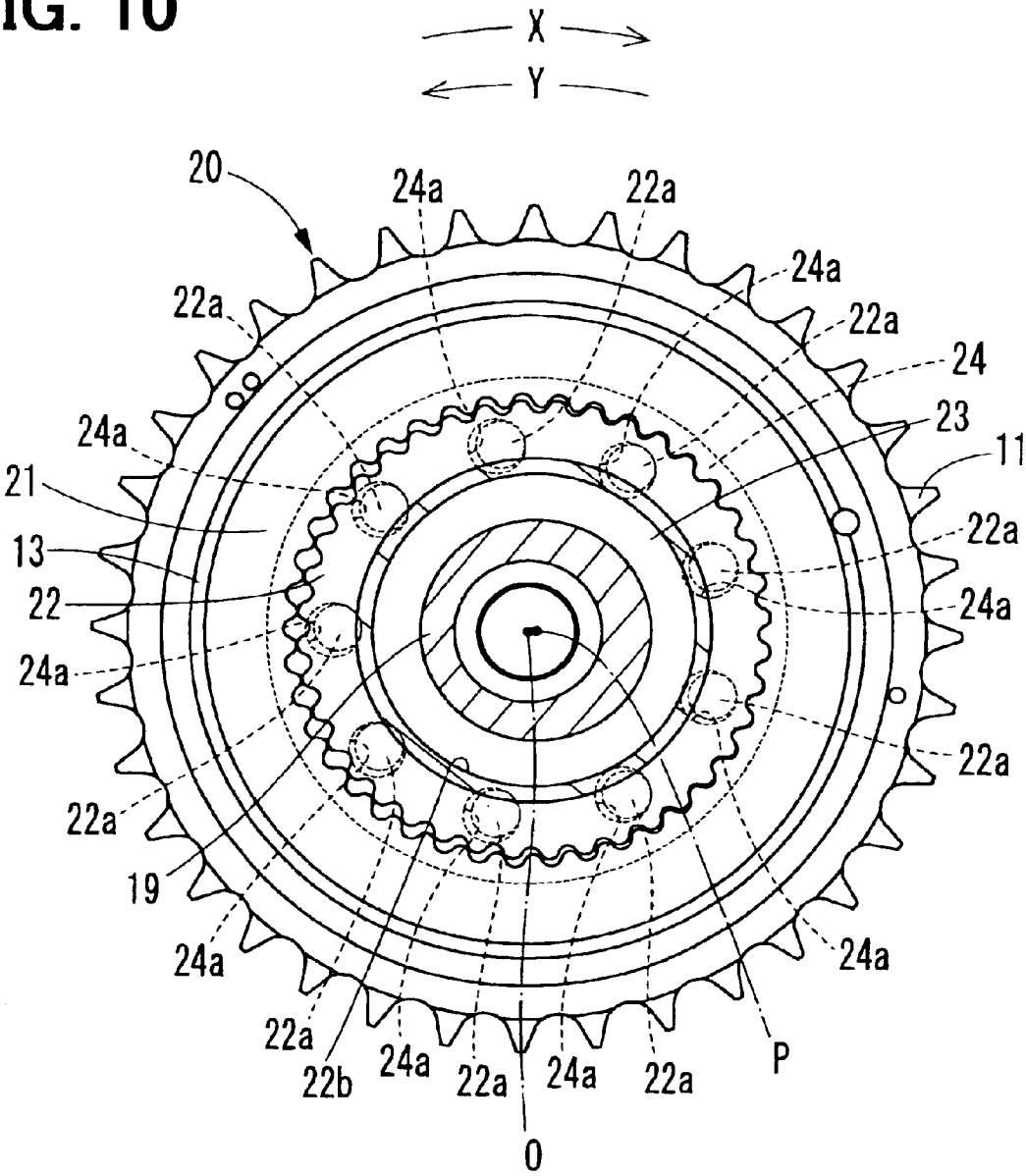
FIG. 10 is a cross-sectional view of the first embodiment of the present invention taken through line X—X of FIG. 2.

Next, the speed reducer 20 will be described. As shown in FIG. 2 and FIG. 10, the speed reducer 20 is constructed of a ring gear 21, the eccentric shaft 19, a planetary gear 22, a bearing 23, and a transmission rotary body 24. However, it should also be appreciated that the speed reducer 20 may be constructed in an alternative manner capable of serving the principles of the present invention.

The ring gear 21 is fixed concentrically to an inner peripheral wall of the input cylinder part 13. The ring gear 21 is constructed of an internal gear that has a tip surface on an inner peripheral side of a root surface. The ring gear 21 rotates integrally with the sprocket 11 around the rotational centerline O in the clockwise direction relative to the view shown in FIG. 10.

The eccentric shaft 19 is fixedly coupled to the rotary shaft 33 of the electric motor 30, thereby being arranged eccentrically with respect to the rotational centerline O. In FIG. 10, a reference symbol P denotes the center axis of the eccentric shaft 19. The planetary gear 22 is constructed of an external gear having a tip surface on an outer peripheral side of a root surface. A radius of curvature of the tip surface of the planetary gear 22 is smaller than a radius of curvature of the root surface of the ring gear 21. Furthermore, the planetary gear 22 includes one more tooth than the ring gear 21. The planetary gear 22 is arranged on the inner peripheral side of the ring gear 21. A portion of the teeth on the planetary gear 22 engages a portion of the teeth on the ring gear 21. This enables the planetary gear 22 to rotate in a planetary movement. A cylindrical hole 22*b* is concentrically formed in the planetary gear 22. An end portion of the eccentric shaft 19 is fitted in a relatively rotatable manner in the cylindrical hole 22*b* via the bearing 23. With this fitting, the eccentric shaft 19 and the rotary shaft 33 can rotate in the advance direction X and in the delay direction Y relative to the sprocket 11.

The transmission rotary body 24 includes a circular plate shape and is arranged such that both surfaces of the plate are substantially vertical to a line that is parallel to the rotational centerline O. The transmission rotary body 24 includes engaging holes 24*a*. The engaging holes 24*a* are each shaped like a cylindrical hole. The engaging holes 24*a* are positioned at equal intervals around the rotational centerline O. The planetary gear 22 that is opposite the transmission rotary body 24 from the guide rotary body 26 has engaging protrusions 22*a*. The engaging protrusions 22*a* on the planetary gear 22 protrude in a cylindrical shape toward the engaging holes 24*a*. The engaging protrusions 22*a* are positioned at equal intervals around the eccentric axis P of the eccentric shaft 19 and are received by the engaging holes 24*a*.

Therefore, when the crankshaft provides a constant control torque to the rotary shaft 33, which is then transmitted to the eccentric shaft 19, the planetary gear 22 rotates integrally with the sprocket 11, the eccentric shaft 19, and the rotary shaft 33. Furthermore, the planetary gear 22 maintains an engaging position with the ring gear 21. This causes the engaging protrusions 22*a* to apply a rotational force to the engaging holes 24*a*. The rotational force cause the transmission rotary body 24 to rotate along with the guide rotary body 25 around the rotational centerline O in the clockwise direction relative to the view shown in FIG. 10 wile maintaining the rotational phase of the sprocket 11.

When the control torque transmitted to the eccentric shaft 19 increases in the counterclockwise direction relative to the view shown in FIG. 10, the planetary gear 22 rotates clockwise relative to the eccentric shaft 19 and the sprocket 11. This increases the force by which the engaging protrusions 22*a* press the engaging holes 24*a* in the rotational direction and the transmission rotary body 24 rotates along with the guide rotary body 25 in the advance direction X relative to the sprocket 11.

When the control torque transmitted to the eccentric shaft 19 increases in the clockwise direction relative to the view shown in FIG. 10, the planetary gear 22 rotates counterclockwise relative to the eccentric shaft 19 and the sprocket 11. This causes the engaging protrusions 22*a* to press the engaging holes 24*a* in a direction opposite to the rotation, thereby causing the transmission rotary body 24 to rotate with the guide rotary body 25 in the delay direction Y relative to the sprocket 11.

Next, the characteristic operation of the valve timing adjustment device 1 will be described.

Immediately before the engine is started, a pressing torque in the advance direction X that presses the movable body 26 onto the stopper 62*a* is applied to the guide rotary body 25 by the electric motor 30 and the speed reducer 20. This causes the movable body 26 to be positioned at the end 66*a* of the gradually decreasing region 66. This ensures that the intermediate phase shown in FIG. 1 is achieved with precision and the engine can start. Hence, this prevents the occurrence of a malfunction that can cause the engine to not start. In this manner, the electric motor 30 and the speed reducer 20 provide torque application means in accordance with the first embodiment.

When the engine is started, the electric motor 30 and the speed reducer 20 rotate the guide rotary body 25 in the delay direction Y relative to the sprocket 11. This causes the movable body 26 to move to the connection boundary between the regions 66 and 68. With this, the shaft phase is changed to the delay side to be made the most delayed phase. The most delayed phase causes the quantity of air charged into an engine combustion chamber to decrease, thereby preventing a pressure increase in the engine combustion chamber during a compression stroke. As a result, the number of revolutions of the engine increases easily, even in a low temperature environment.

When the number of revolutions of the engine increases to a predetermined value, the electric motor 30 and the speed reducer 20 rotate the guide rotary body 25 in the delay direction Y relative to the sprocket 11. This causes the movable body 26 to move to the end 68*b* of the gradually increasing region 68. With this, the shaft phase is changed to the advance side to be made the most advanced phase. The most advanced phase causes the quantity of air charged in the engine combustion chamber to increase, thereby greatly increasing a pressure in the engine combustion chamber during a compression stroke. As a result, the engine develops complete combustion and is brought to a steady driving mode.

Thereafter, a normal control is performed. The normal control includes reciprocating the movable body 26 between the ends 68*a* and 68*b* of the gradually increasing region 68 to change the shaft phase.

When the engine is stopped, the electric motor 30 and the speed reducer 20 rotate the guide rotary body 25 in the advance direction of X relative to the sprocket 11. This causes the movable body 26 to move to the end 66*a* of the gradually decreasing region 66.

According to the first embodiment described above, when the engine is started to attain a steady driving mode, the direction of change of the shaft phase can be switched from the delay side to the advance side once by moving the movable body 26 from one side of the guide passage 64 to the other. This is true even if the rotational direction of the guide rotary body 25 relative to the sprocket 11 is not changed. Therefore, the valve timing adjustment device 1 of the first embodiment reduces the time required to switch the direction of change of the shaft phase. This provides the engine with the capability to quickly reach the steady driving state, even in a low temperature environment.

Furthermore, according to the first embodiment, the gradually decreasing region 66 and the gradually increasing region 68 are formed of generally straight-line shapes, except for the ends 66*b* and 68*a*. This enables these portions to be easily formed. Additionally, the end 66*b* of the gradually decreasing region 66 and the end 68*a* of the gradually increasing region 68 are connected in a curve shape. This provides the change rate of the distance R in the radial direction of the gradually decreasing region 66 and the gradually increasing region 68 to be set according to the above-described angle θ. In short, this enables the degree of the change rate of the distance R in the radial direction of each of the regions 66 and 68 to be increased.

Second Embodiment

Figure 11:
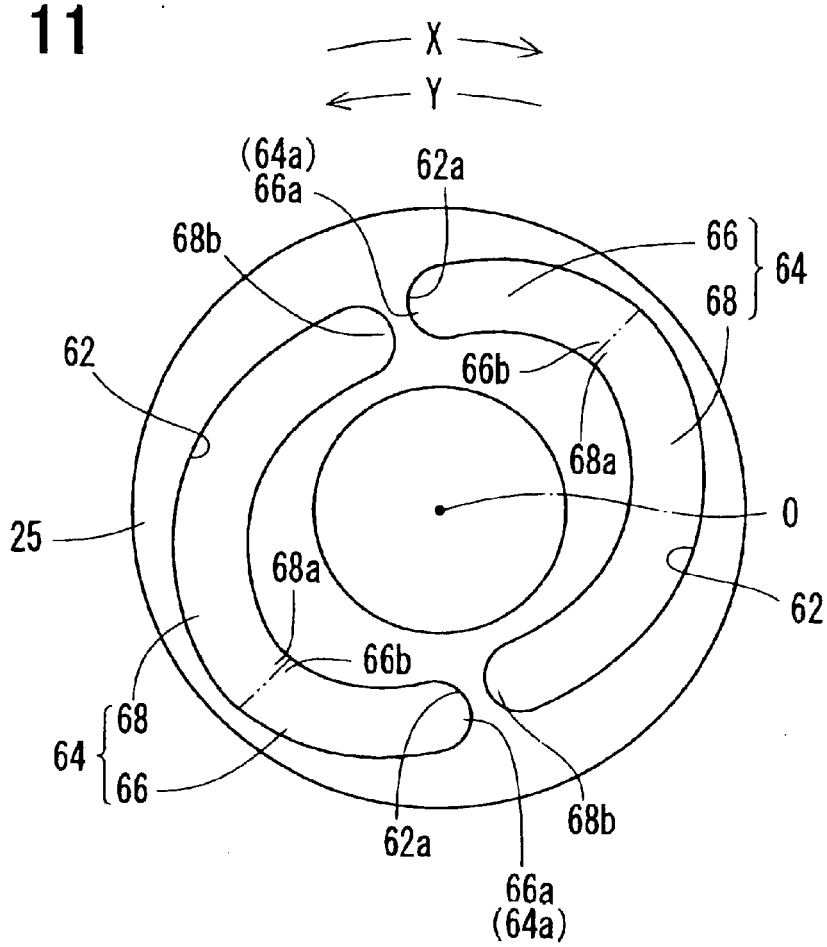
FIG. 11 is a front view of a guide rotary body of a second embodiment of the present invention.

FIG. 11 depicts a valve timing adjustment device in accordance with the second embodiment of the present invention. The second embodiment of the present invention is a modification of the first embodiment and, therefore, substantially same constituent parts denoted by the same reference symbols.

In the second embodiment, the gradually decreasing region 66 and the gradually increasing region 68 are formed in a curved shape. Furthermore, the end 66*b* of the gradually decreasing region 66 and the end 68*a* of the gradually increasing region 68 are connected to each other in a curved shape. Here, a double dot and dashed line in FIG. 11 shows the connection boundary between the end 66*b* and the end 68*a*.

Figure 12:
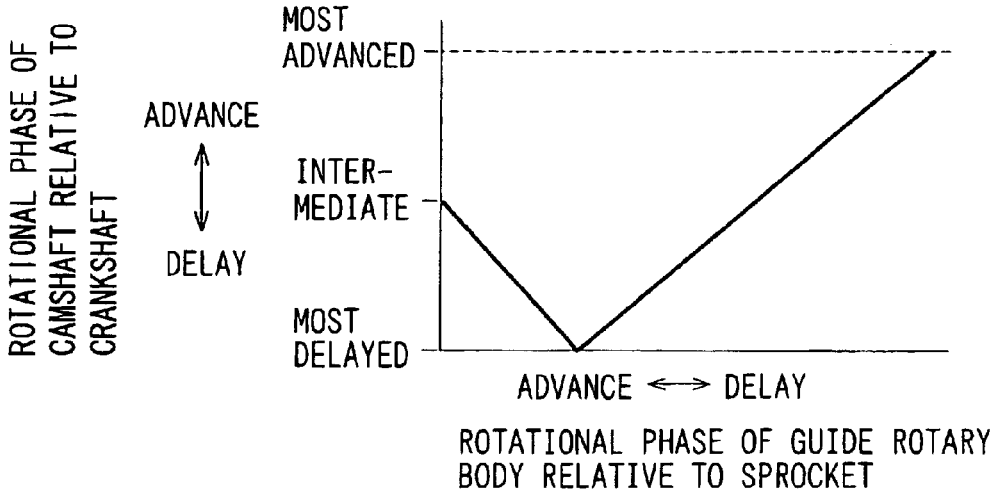
FIG. 12 is a graph illustrating operational characteristics of the second embodiment of the present invention.

According to the second embodiment and as shown in FIG. 12, the shaft phase can be changed linearly with respect to the rotational phase of the guide rotary body 25 to the sprocket 11. This provides a constant ratio of speed-reduction between the guide rotary body 25 and the camshaft 2 such that the shaft phase can be controlled with ease and precision.

Third Embodiment

Figure 13:
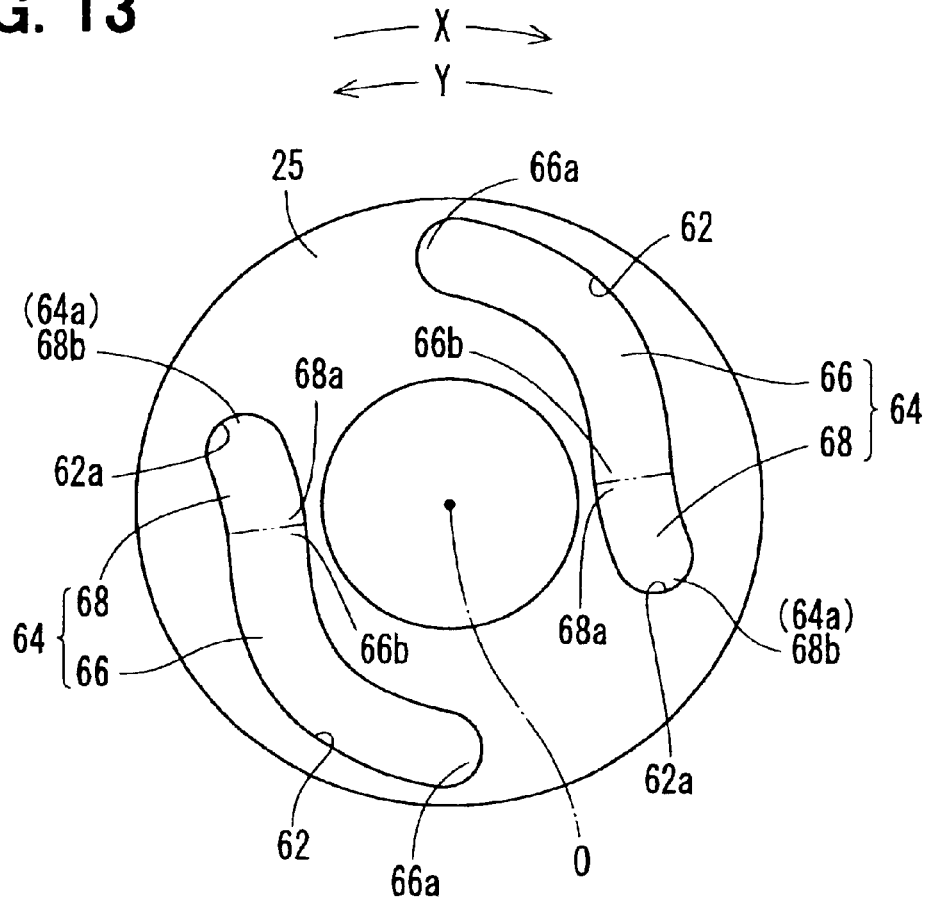
FIG. 13 is a front view of a guide rotary body of a third embodiment of the present invention.

FIG. 13 depicts a valve timing adjustment device in accordance with a third embodiment of the present invention. The third embodiment of the present invention is a modification of the first embodiment and, therefore, substantially same constituent parts are denoted by the same reference symbols.

In the third embodiment, the gradually decreasing region 66 is slanted from the end 66*b* toward the end 66*a* in the delay direction Y and away from the rotational centerline O. Furthermore, the end 64*a* of the guide passage 64 blocked by the stopper 62*a* is common with the end 68*b* of the gradually increasing region 68. The gradually increasing region 68 is slanted from the end 68*a* toward the end 68*a* in the advance direction X and away from the rotational centerline O. Still further, the gradually decreasing region 66 and the gradually increasing region 68 are formed in a curve shape, respectively. Furthermore, the end 66*b* of the gradually decreasing region 66 and the end 68*a* of the gradually increasing region 68 are connected to each other in a curve shape. Here, a double dot and dashed line in FIG. 13 shows the connection boundary between the end 66*b* the gradually decreasing region 66 and the end 68*a* of the gradually increasing region 68.

Figure 14:
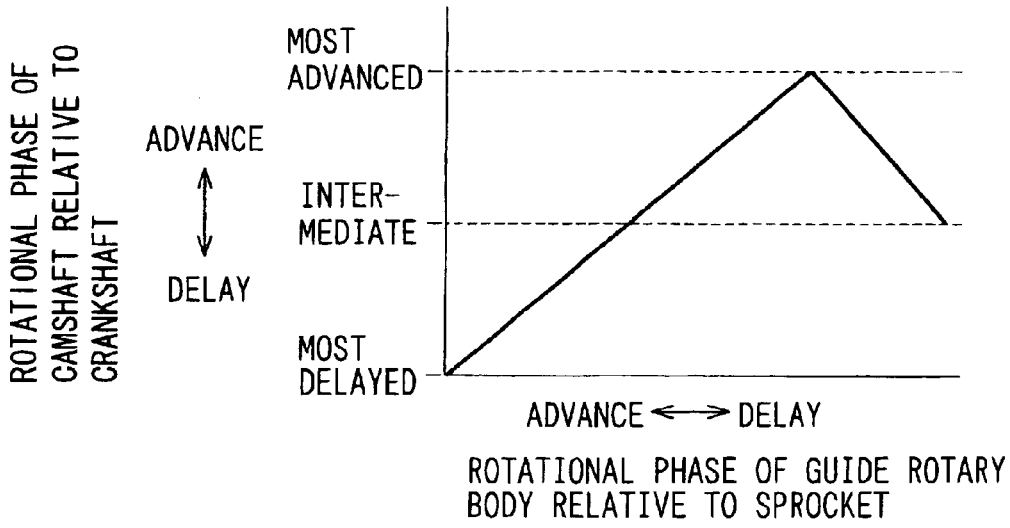
FIG. 14 is a graph illustrating operational characteristics of the third embodiment of the present invention.

Accordingly, the shaft phase becomes the most delayed phase when the movable body 26 moves to the end 66*a* of the gradually decreasing region 66, as shown in FIG. 14. The shaft phase becomes the most advanced phase when the movable body 26 moves to the connection boundary between the gradually decreasing region 66 and the gradually increasing region 68, as shown in FIG. 14. The shaft phase becomes an intermediate phase when the movable body 26 moves to the end 68*b* of the gradually increasing region 68, as shown in FIG. 14. Hence, the direction of change of the shaft phase can be switched from the advance side to the delay side once by moving the movable body 26 from one side of the guide passage 64 to the other in the length direction. This is achieved through the relative rotation of the guide rotary body 25 to the sprocket 11 even if the relative rotational direction of the guide rotary body 25 to the sprocket 11 is not changed. Additionally, as shown in FIG. 14, the shaft phase can be changed linearly with respect to the rotational phase of the guide rotary body 25 to the sprocket 11. This provides a constant ratio of speed reduction between the guide rotary body 25 and the camshaft 2 such that the shaft phase can be controlled with ease and with precision.

Fourth Embodiment

Figure 15:
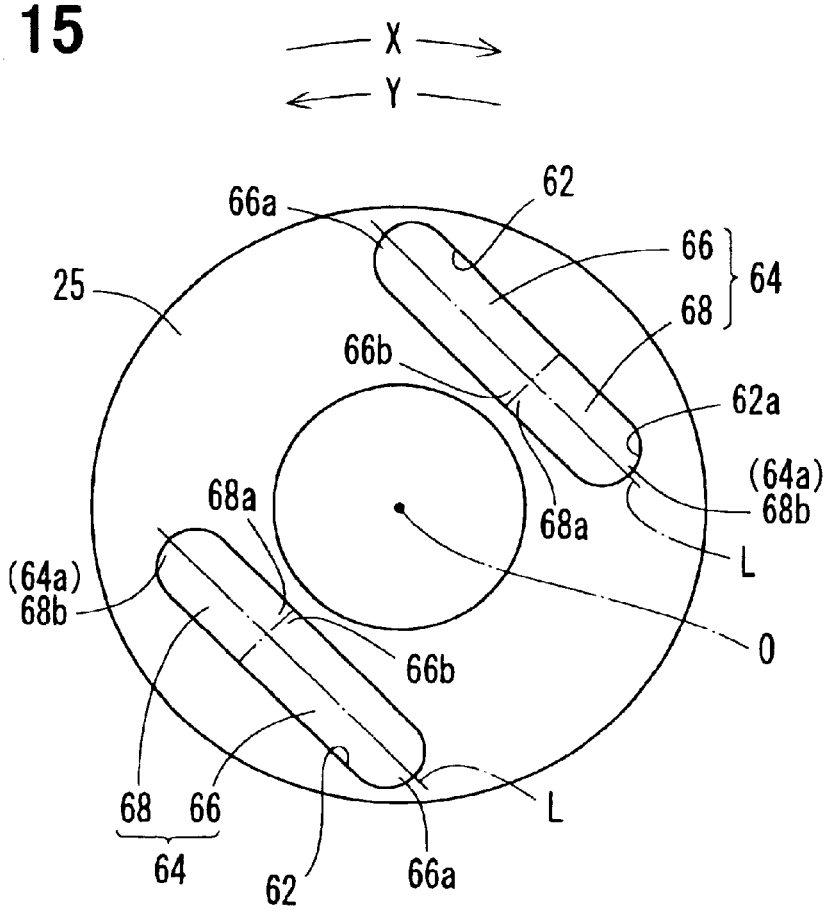
FIG. 15 is a front view of a guide rotary body of a fourth embodiment of the present invention.

FIG. 15 depicts a valve timing adjustment device in accordance with the fourth embodiment of the present invention. The fourth embodiment is a modification of the third embodiment and, therefore, substantially same constituent parts are denoted by the same reference symbols.

In the fourth embodiment, the gradually decreasing region 66 and the gradually increasing region 68 extend along a common imaginary straight line L. A double dot and dashed line in FIG. 15 shows the connection boundary between the end 66*b* of the gradually decreasing region 66 and the end 68*a* of the gradually increasing region 68.

Figure 16:
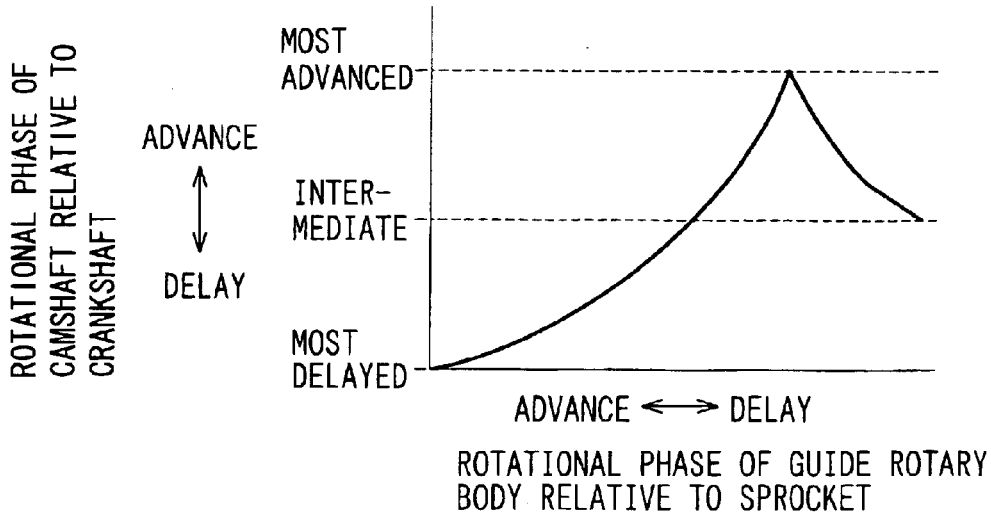
FIG. 16 is a graph illustrating operational characteristics of the fourth embodiment of the present invention.

Also in the fourth embodiment, each of the regions 66, 68 extend on a slant relative to an axis in the radial direction of the guide rotary body 25 such that a distance R in the radial direction either gradually decreases or increases as the regions become closer to one end 64*a* of the passage 64. Therefore, the shaft phase becomes the most delayed phase when the movable body 26 moves to the end 66*a* of the gradually decreasing region 66, as shown in FIG. 16. Furthermore, the shaft phase becomes the most advanced phase when the movable body 26 moves to the connection boundary between the gradually decreasing region 66 and the gradually increasing region 68, as shown in FIG. 16. Still further, the shaft phase becomes an intermediate phase when the movable body 26 moves to the end 68*b* of the gradually increasing region 68, as shown in FIG. 16.

Fifth Embodiment

Figure 17:
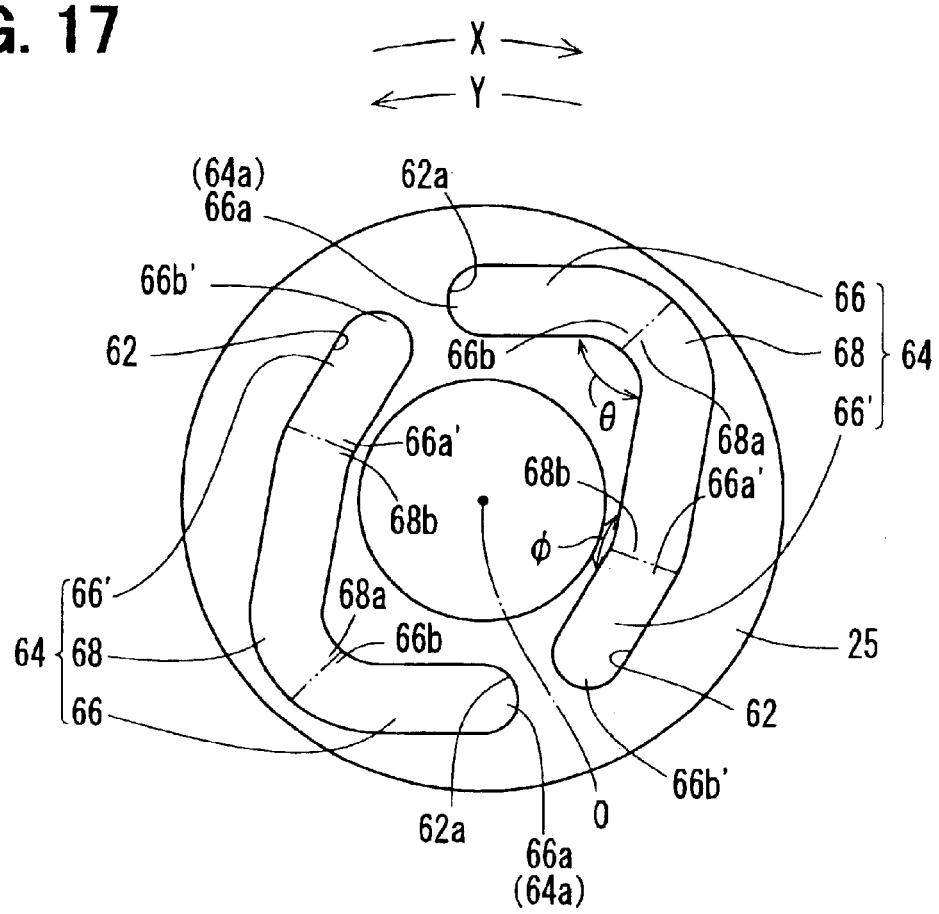
FIG. 17 is a front view of a guide rotary body of a fifth embodiment of the present invention.

FIG. 17 depicts a valve timing adjustment device in accordance with the fifth embodiment of the present invention. The fifth embodiment of the present invention is a modification of the first embodiment and, therefore, substantially same constituent parts are denoted by the same reference symbols.

The guide passage 64 of the fifth embodiment has not only the gradually decreasing region 66 of the same construction as the first embodiment (hereinafter referred to as "first gradually decreasing region 66") but also another gradually decreasing region 66' (hereinafter referred to as "second gradually decreasing region 66'"). The second gradually decreasing region 66' is a region that extends on a slant relative to an axis in the radial direction of the guide rotary body 25. Furthermore, the second decreasing region 66' increases in the distance R in the radial direction as it becomes closer to one end 64*a* of the passage 64. One end 66*a* of the second gradually decreasing region 66' is connected to the end 68*b* of the gradually increasing region 68 in the length direction of the passage 64. Therefore, the gradually increasing region 68 is sandwiched between the first gradually decreasing region 66 and the second decreasing region 66'. Here, double dot and dash lines in FIG. 17 show the connection boundaries between the end 66*a'* of the second gradually decreasing region 66' and the end 68*b* of the gradually increasing region 68 and the connection boundary between the end 66*b* of the first gradually decreasing region 66 and the end 68*a* of the gradually increasing region 68.

The second gradually decreasing region 66', in particular, extends on a slant away from the centerline O from the end 66*a'* toward the end 66*b'* in the advance direction X. Furthermore, the second gradually decreasing region 66' is shorter than the gradually increasing region 68. Further yet, the second gradually decreasing region 66' and the gradually increasing region 68 are formed in straight lines, except for the end 66*a'* and the end 68*b*, respectively. The end 66*a'* of the second gradually decreasing region 66' and the end 68*b* of the gradually increasing region 68 are connected to each other in a curve shape. Further yet, the second gradually decreasing region 66' extends at a suitably set angle (ϕ from the gradually increasing region 68 except at portions near the end 66*a'* and the ends 68*a*, 68*b*.

Figure 18:
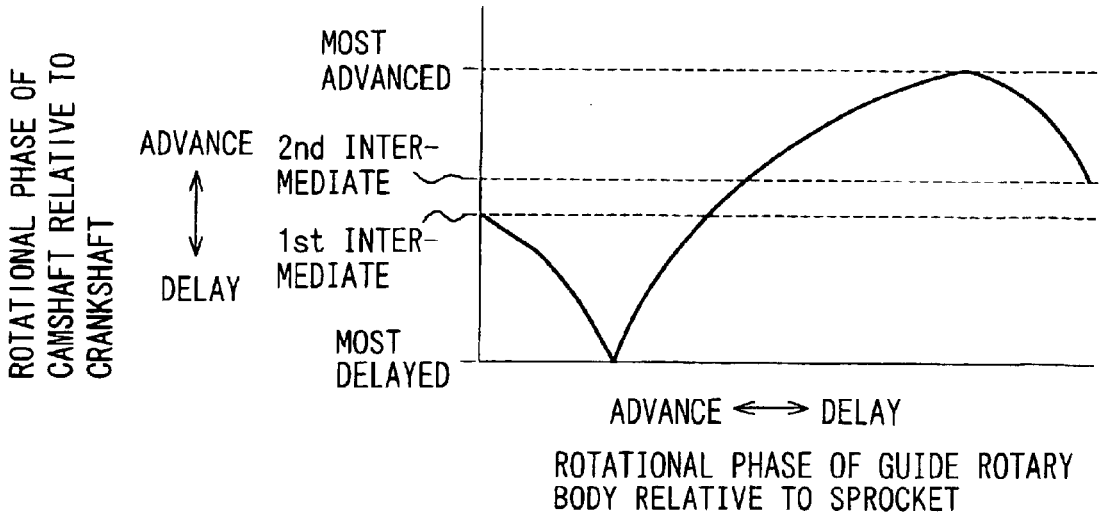
FIG. 18 is a graph illustrating operational characteristics of the fifth embodiment of the present invention.

Therefore the shaft phase becomes the first intermediate phase when the movable body 26 moves to the end 66*a* of the first decreasing region 66, as shown in FIG. 18. The shaft phase becomes the most delayed phase when the movable body 26 moves to the connection boundary between the first gradually decreasing region 66 and the gradually increasing region 68, as shown in FIG. 18. The shaft phase becomes the most advanced phase when the movable body 26 moves to the connection boundary between the gradually increasing region 68 and the second gradually decreasing region 66', as shown in FIG. 18. The shaft phase becomes the second intermediate phase when the movable body 26 moves to the end 66*b'* of the second decreasing region 66', as shown in FIG. 18. Therefore, the direction of change of the shaft phase can be switched twice by moving the movable body 26 from one side of the guide passage 64 to the other without switching the relative rotational direction of the guide rotary body 25 to the sprocket 11.

Sixth Embodiment

Figure 19:
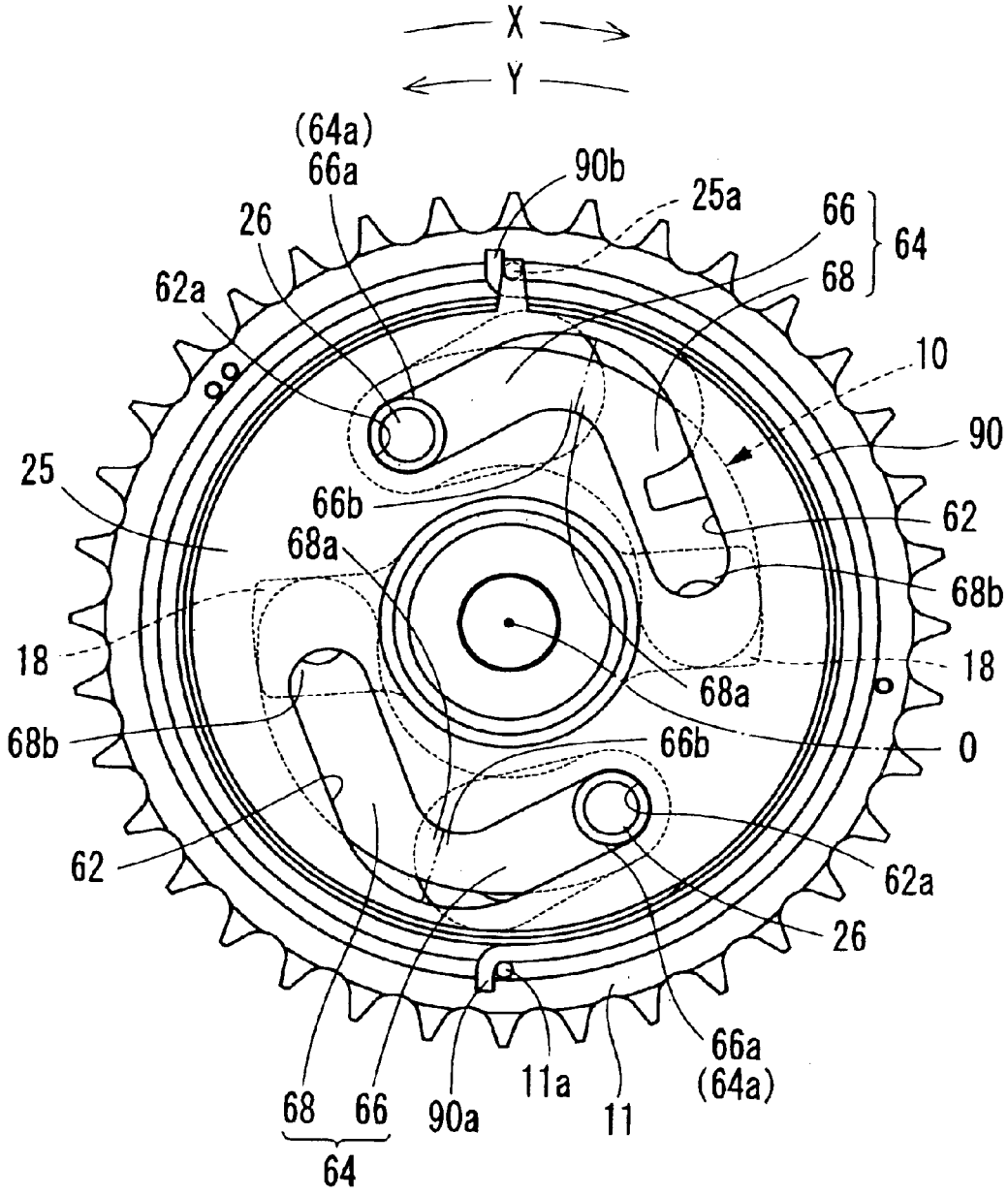
FIG. 19 is a cross-sectional view of the sixth embodiment of the present invention taken through a line corresponding to line I—I of FIG. 2 of the first embodiment of the present invention.

FIG. 19 depicts a valve timing adjustment device in accordance with the sixth embodiment of the present invention. The sixth embodiment is a modification of the first embodiment and, therefore, substantially same constituent parts are denoted by the same reference symbols.

In the sixth embodiment, a torsion spring 90 in the form of an elastic member provides a torque application means for generating a pressing torque.

To be specific, a first end portion 90*a* of the torsion spring 90 is retained by a protrusion 11*a* of the sprocket 11 and a second end portion 90*b* of the torsion spring 90 is retained by the protrusion 25*a* on the guide rotary body 25. Therefore, the torsion spring 90 provides torque in the delay direction Y relative to the sprocket 11. The torsion spring 90 is torsionally deformed as the guide rotary body 25 rotates in the delay direction Y relative to the sprocket 11. This deformation applies a torque in the advance direction X to the guide rotary body 25. Therefore, when the movable body 26 is positioned at the end 66*a* of the gradually decreasing region 66, as shown in FIG. 19, the torque in the advance direction X applied to the guide rotary body 25 by the torsion spring 90 forces the movable body 26 into engagement with the stopper 62*a*. This secures the movable body 26 into position at the end 66*a* to correctly define the intermediate phase to start the engine.

In this manner, the torque in the advance direction X that is applied to the guide rotary body 25 by the torsion spring 90 is utilized as the pressing torque.

Seventh Embodiment

Figure 20:
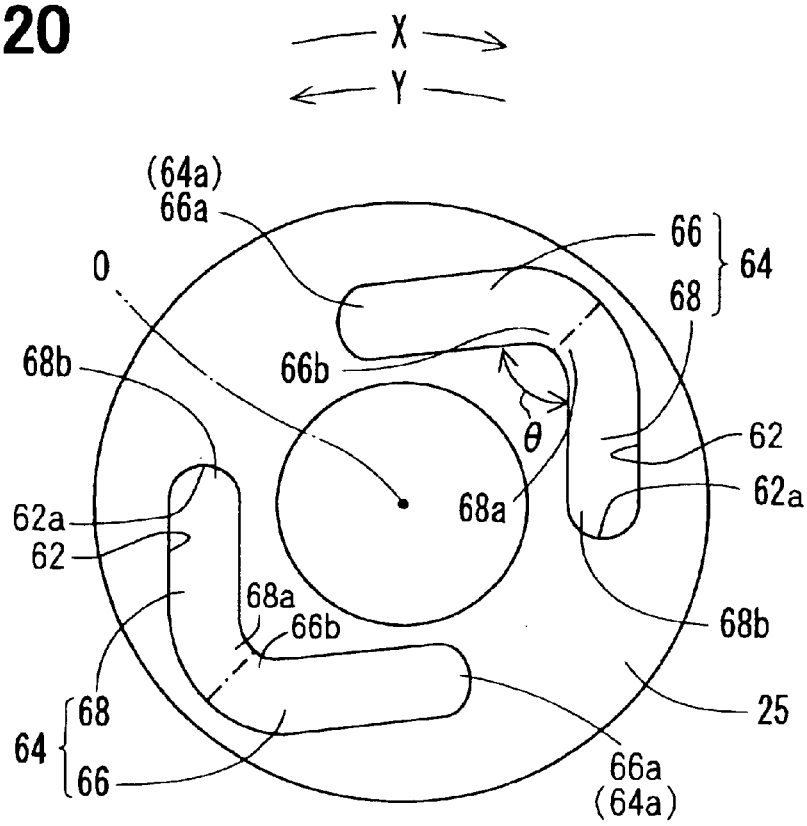
FIG. 20 is a front view of a guide rotary body of a seventh embodiment of the present invention.
Figure 21:
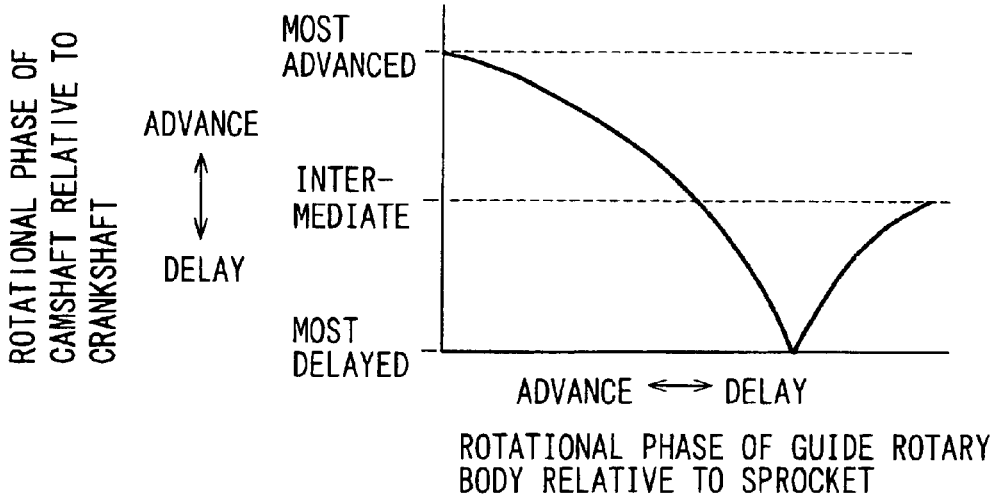
FIG. 21 is a graph illustrating operational characteristics of the seventh embodiment of the present invention.

FIG. 20 depicts a guide rotary body 25 of a valve timing adjustment device according to the seventh embodiment of the present invention. This embodiment is a variation of the first embodiment described above. Components of the guide rotary body 25 presented in FIG. 20 that are equivalent to those of the first embodiment are identified by like reference numerals. However, the guide rotary body 25 of the seventh embodiment includes a stopper 62*a* disposed at the end of the gradually increasing region 68 that is opposite to the gradually decreasing region 66. Accordingly, the seventh embodiment provides the same effect as the first embodiment for the case of the guide rotary body 25 rotating relative to the sprocket 11 in a direction that is opposite to that of the first embodiment while both starting the engine and during constant operation. Furthermore, the guide rotary body 25 of the seventh embodiment defines an intermediate phase that is between a most delayed phase and a most advanced phase when a movable body 26 (not shown in FIG. 20) is positioned adjacent to the end of the gradually increasing region 68 that is opposite the gradually decreasing region 66. Therefore, when the guide rotary body 25 of the seventh embodiment rotates in the delay direction Y relative to the sprocket 11 (not shown in FIG. 20), the phase change mechanism 10 can achieve an intermediate phase, as is illustrated in FIG. 21. On the other hand, when the guide rotary body 25 of the seventh embodiment rotates in the advance direction X relative to the sprocket 11 (not shown in FIG. 20), the phase change mechanism 10 can achieve an advanced phase, as shown in FIG. 21.

Accordingly, the first to the sixth embodiments described above provide examples in which the present invention is applied to a device for adjusting a valve timing of an intake valve. Alternatively, the present invention may be applied to a device for adjusting a valve timing of an exhaust valve or a device for adjusting both the valve timings of an intake valve and an exhaust valve.

Furthermore, while the fifth embodiment discloses two gradually decreasing regions 66, 66' sandwiching a gradually increasing region 68, a device including two gradually increasing regions sandwiching a gradually decreasing region 66 is also intended to be within the scope of the present invention. Furthermore, the present invention is intended to include a plurality of gradually decreasing regions and a plurality of gradually increasing regions arranged in the length direction of the guide passage 64 such that they are alternately connected to each other. Further yet, the present invention is envisioned to include a plurality of gradually decreasing regions sandwiching a gradually increasing region a plurality of gradually increasing regions sandwiching a gradually decreasing region.

Still further, the first to sixth embodiments described above disclose the guide passage 64 being defined by the peanut slot 62 of the guide rotary body 25 and having opposing side wall parts 62*b*, 62*c* on both sides in the width direction of the guide passage 64. Alternatively, a wall part along which the guide passage 64 extends may be provided only on one side in the width direction of the guide passage 64. However, it should be appreciated that in this case, it would be desirable to adopt a construction that is capable of pressing the movable body 26 onto the wall part on one side in the width direction of the guide passage 64.

Still further, while the first to the fifth embodiments have disclosed the torque application means for generating a pressing torque as including an electric motor 30 and a speed reducer 20, an alternative embodiment of the present invention may include a torque application means having only an electric motor 30. Additionally, the torque application means may include a device having a braking member and a solenoid. The crankshaft may rotate the braking member. The solenoid may magnetically attract the braking member to provide a braking torque. The braking torque may then be utilized as a pressing torque.

Further yet, in the sixth embodiment, the torque application means for generating a pressing torque is constructed of a torsion spring 90 in the form of an elastic member. Alternatively, an elastically deformable member such as a tension coil spring, a compression coil spring, or some similar device may be used as the toque application means.

What is claimed is:

1. A valve timing adjustment device for controlling and adjusting a timing of at least one of an intake valve and an exhaust valve provided in a transmission system for transmitting drive torque from a drive shaft to a driven shaft, the device comprising:

a driving rotary body rotating in synchronization with the drive shaft;

a movable body;

a guide rotary body including a guide passage having a variable dimension extending radially from a rotational centerline adapted to rotate relative to the driving rotary body to guide the movable body in a length direction of the guide passage; and a phase change means for setting a rotational phase of the driven shaft relative to the drive shaft to one of a delay side and an advance side when the movable body moves away from the rotational centerline and setting the rotational phase of the driven shaft to the other of the delay side and the advance side when the movable body moves closer to the rotational centerline, wherein the guide passage includes a gradually decreasing region and a gradually increasing region that are connected to each other in the length direction, the gradually decreasing region extends on a slant relative to an axis in a radial direction of the guide rotary body and includes a radial dimension relative to the axis that decreases toward an end of the guide passage, and the gradually increasing region extends on a slant relative to the axis in the radial direction of the guide rotary body and includes a radial dimension relative to the axis that increases toward the end of the guide passage.

2. The valve timing adjustment device as claimed in claim 1, wherein the guide rotary body includes a stopper at the end of the guide passage for retaining the movable body, and the phase change means sets the rotational phase to an intermediate phase that is located between a most delayed phase and a most advanced phase when the movable body is located at the end of the gradually decreasing region.

3. The valve timing adjustment device as claimed in claim 2, wherein the phase change means sets the rotational phase to one of the most delayed phase and the most advanced phase when the movable body is located at a connection boundary located between the gradually decreasing region and the gradually increasing region and sets the rotational phase to the other of the most delayed phase and the most advanced phase when the movable body is located at an end of the gradually increasing region that is located opposite from the connection boundary.

4. The valve timing adjustment device as claimed in claim 2, further comprising a torque application means for applying a pressing torque to press the movable body into engagement with the stopper of the guide rotary body.

5. The valve timing adjustment device as claimed in claim 4, wherein the torque application means includes an electric motor for generating the pressing torque.

6. The valve timing adjustment device as claimed in claim 4, wherein the torque application means includes an elastic member for generating the pressing torque.

7. The valve timing adjustment device as claimed in claim 1, wherein the guide rotary body includes a stopper for retaining the movable body at an end of the gradually increasing region that is opposite from the gradually decreasing region, and the phase change means sets the rotational phase to an intermediate phase located between a most delayed phase and a most advanced phase when the movable body is located at the end of the gradually increasing region that is opposite from the gradually decreasing region.

8. The valve timing adjustment device as claimed in claim 4, wherein the phase change means sets the rotational phase to one of the most delayed phase and the most advanced phase when the movable body is located at a connection boundary located between the gradually decreasing region and the gradually increasing region, and sets the rotational phase to the other of the most delayed phase and the most advanced phase when the movable body is located at the end of the gradually decreasing region that is opposite the gradually decreasing region.

9. The valve timing adjustment device as claimed in claim 1, wherein the gradually decreasing region includes a plurality of gradually decreasing regions sandwiching the gradually increasing region.

10. The valve timing adjustment device as claimed in claim 1, wherein gradually increasing region includes a plurality of gradually increasing regions sandwiching the gradually decreasing region.

11. The valve timing adjustment device as claimed in claim 1, wherein the gradually decreasing region and the gradually increasing region are formed in a substantially straight-line shape except for an end of the gradually decreasing region that connects to an end of the gradually increasing region in a curve shape.

12. The valve timing adjustment device as claimed in claim 1, wherein the gradually decreasing region and the gradually increasing region are formed of a curved shape including an end on a gradually increasing region side of the gradually decreasing region and an end on the gradually decreasing region side of the gradually increasing region that are connected to each other.

13. The valve timing adjustment device as claimed in claim 1, wherein the gradually decreasing region and the gradually increasing region extend along a common straight line.

* * * * *